US005172998A

United States Patent [19]

Hatagishi

[11] Patent Number: 5,172,998

[45] Date of Patent: Dec. 22, 1992

[54] CONNECTOR WITH A LEVER

[75] Inventor: Yuji Hatagishi, Shizuoka, Japan

[73] Assignee: Yazaki Corporation, Tokyo, Japan

[21] Appl. No.: 805,944

[22] Filed: Dec. 12, 1991

[30] Foreign Application Priority Data

Dec. 15, 1990 [JP] Japan ..... 2-410807

[51] Int. Cl.[5] ..... B25G 3/00

[52] U.S. Cl. ..... 403/27; 403/322; 403/330; 285/312; 439/296

[58] Field of Search ..... 403/322, 330, 24, 27; 285/312, 311; 439/296, 299, 310, 312

[56] References Cited

U.S. PATENT DOCUMENTS 3,345,604 10/1967 Henschen et al. ..... 439/310
4,083,619 4/1978 McCormick et al. ..... 439/310
5,017,147 5/1991 Sugiyama et al. ..... 439/229 X

FOREIGN PATENT DOCUMENTS 52-133993 10/1977 Japan .
2-56876 2/1990 Japan .
278674 11/1990 Japan ..... 439/310
952651 3/1964 United Kingdom ..... 439/310

*Primary Examiner*—Andrew V. Kundrat
*Attorney, Agent, or Firm*—Jacobson, Price, Holman & Stern

[57] ABSTRACT

A connector having a pair of opposed housings capable of being fitted to and detached from each other, guide slits formed in one of the housings, driven pins provided on the other housing, and a lever rotatably attached to the one of the housings and capable of engaging with the driven pins. The housings are fitted to or detached from each other by an operation of rotating the lever. Mating engagement holes and projections capable of engaging with each other when the housings are normally fitted are provided on one of the housings and the lever, and other engagement holes and projections for fitting confirmation are provided on the other housing and the lever. Therefore the operator can easily confirm the locked state of the lever with eye. Also, the facility with which the connector is designed and manufactured is improved.

8 Claims, 5 Drawing Sheets

CONNECTOR WITH A LEVER

BACKGROUND OF THE INVENTION

This invention relates to a connector having a pair of opposed mail and female housings and a lever rotatably operable to fit/separate these housings and, more particularly, to a connector with a lever designed so that a completely fitted state can easily be confirmed with eye.

A connector of this kind, having a lever, is known which has a structure, such as that as shown in FIGS. 7A and 7B, including a receptacle a having a projection al and provided as a female housing, a plug b provided as a male housing, and an arm or lever c having a guide groove $c_1$ and rotatably provided on the plug b. The plug b is fitted to or detached from the receptacle a by rotating the arm c while engaging the projection $a_1$ and the guide groove $c_1$. (See Japanese Utility Model Laid-Open Publication No. 52-133933.)

To confirm whether or not the arm c is completely locked, the operator may confirm with eye that an operation point $c_2$ of the arm is located at the rear of a stop spring d.

In this conventional connector having a lever, the stop spring d also serves to lock the lever c, and it is therefore necessary for the stop spring d to have a sufficiently high rigidity such as to securely fix the lever c when the connector is used as well as to have a resiliency such that the lever c can easily be locked. It is therefore preferable to form the stop spring d of a resilient metallic material.

However, if the housing, which is preferably formed of a synthetic resin, is combined with the stop spring formed of a different material, the manufacture cost is increased. If the lock portion and the eye-confirmation portion are formed integrally with the housing, the problem of design restrictions is encountered because the lock portion must be formed at a position such as to be able to be seen. Further, the resultant force of the housing fitting force and the lock insertion force acts as a lever locking force, that is, a large force is required to completely seal the connector. There is therefore a risk of incompletion of connector sealing.

SUMMARY OF THE INVENTION

In view of these problems, an object of the present invention is to provide a connector with a lever in which a completely locked state of the lever can be confirmed at a glance, and which has a structure such as to be easily designed and manufactured.

To achieve this object, according to the present invention, there is provided a connector including a pair of opposed housings, pin guide slits formed in one of the housings so as to extend in the direction of fitting to the other housing, driven pins provided on the other housing on the outside thereof, and a lever rotatably attached to the one of the housings and having drive slits capable of engaging with the driven pins, the housings being fitted to or detached from each other by an operation of rotating the lever. This connector comprises lock means provided on one of the pair of housings and the lever and capable of engaging when the housings are normally fitted to each other, and sensed lock means provided separately of the lock means.

The sensed lock means is separated from the lock means for locking the lever when the pair of housings are fitted, so that the sensed lock means can be provided in a position on the connector such as to be seen most easily. It is therefore easy to confirm the state of locking, and the degree of design/manufacture freedom is improved.

The lock means on the two housings may have a play such that the function of the sensed lock means becomes effective when the lever is further rotated in the connector fitting direction, thereby ensuring that the housings can be completely fitted to each other even if the eye-confirmation operation is omitted.

BRIEF DESCRIPTION OF THE DRAWINGS

FIG. 2A shows a state immediately before the male and female housings are fitted to each other;

FIG. 2B shows a state immediately before the male and female housings are fitted to each other and where a lever member is locked;

FIG. 2C shows a state where the lever member is in a sensed locked position;

DESCRIPTION OF THE PREFERRED EMBODIMENTS

The preferred embodiments of the present invention illustrated in the accompanying drawings will be described below in detail.

Figure 1:
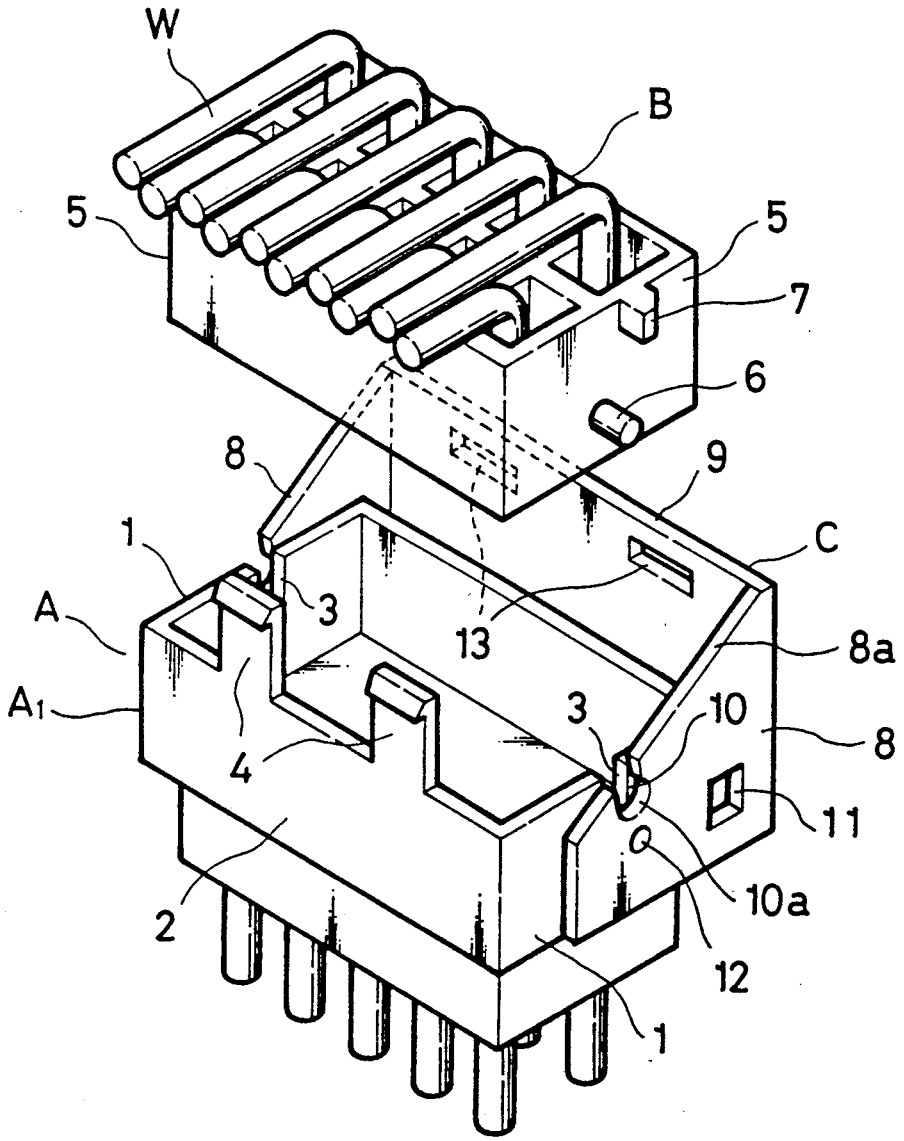
FIG. 1 is a perspective view of a connector with a lever in accordance with a first embodiment of the present invention in a state where male and female housings are separated from each other.

FIG. 1 illustrates a connector with a lever in accordance with the present invention which is constituted of a pair of female and male housings A and B constructed so as to be capable of fitting to and being detached from each other in opposed positions, and a lever member C. Metallic terminal members (not shown) connected to electric wires W are accommodated in each housing.

The female housing A has opposed left and right end walls 1 and opposed longitudinal front and rear side walls 2. These walls form a rectangular hood Al as a fore half of the female housing A to receive the male housing B. Pin guide slits 3 are formed in the end walls 1 so as to extend in the direction of fitting to the male housing. A pair of sensed lock portions 4 are formed on one of the side walls 2 so as to extend outward in the fitting direction.

The male housing B has front and rear walls and left and right end walls 5. Driven pins 6 are formed on lower portions of the end walls 5 so as to project outward and to be inserted and moved in the guide slits 3. Engagement projections 7 are formed on upper portions of the end walls 5.

The lever member C has a pair of opposed left and right lever portions 8, and an operation plate connecting these lever portions. Each lever portion 8 has a drive slit 10 in which the corresponding driven pin 6 is fitted, and an engagement hole 11 capable of engaging with the corresponding engagement projection 7, and is swingably attached to the side wall 1 of the hood $A_1$ by a pin shaft 12. Lock holes 13 capable of engaging with the sensed lock portions 4 are formed in the operation plate 9.

One side 8*a* of each lever portion 8 is formed as a slant surface which descends on the pin shaft 12 side when the lever member C is rotated so as to face laterally. Each drive slit 10 is opened at a position where the slant surface 8*a* and the pin guide slit 3 cross each other. The drive slit 10 is formed so that its inner portion is closer to the pin shaft 12. The drive slit 10 includes a circular hole formed at its inner end 10. This circular slit portion is positioned so that the fitting of the female and male housings A and B is completed when the lever portions 8 are set in a generally upright position. The engagement hole 11 of each lever portion 8 is formed formed so as to be sufficiently larger than the engagement projection 7 and so that the projection 7 is loosely fitted in it.

Figure 2A:
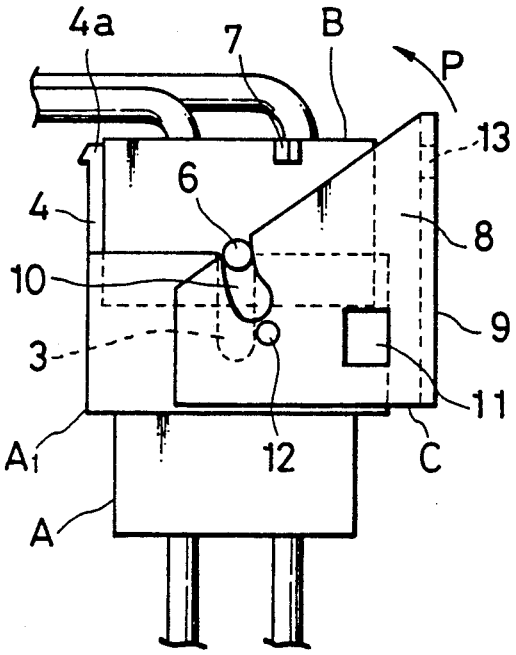
FIGS. 2A to 2C are diagrams of a fitting process of the connector shown in FIG. 1.

The thus-constructed connector is used as described below. The lever member C is set in a lateral position as shown in FIG. 2A to adjust the openings of the slits 10 to the pin guide slits 3. In this state, the male housing B is placed so as to face the opening of the hood $A_1$ and so that its driven pins 6 are positioned at the inlets of the slits 3 and 10. Then, the lever member C is rotated in the direction of arrow P by the operation plate 9. The drive slit 10 and the driven pins 6 are thereby engaged with each other so that the male housing B is moved closer to the female housing A by the leverage.

Figure 2B:
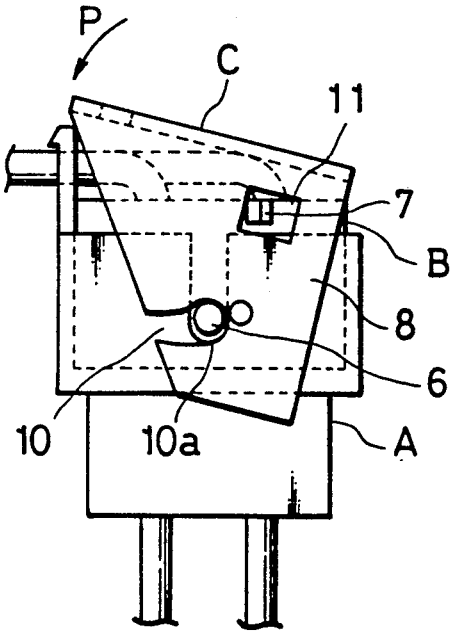
Figure 2C:
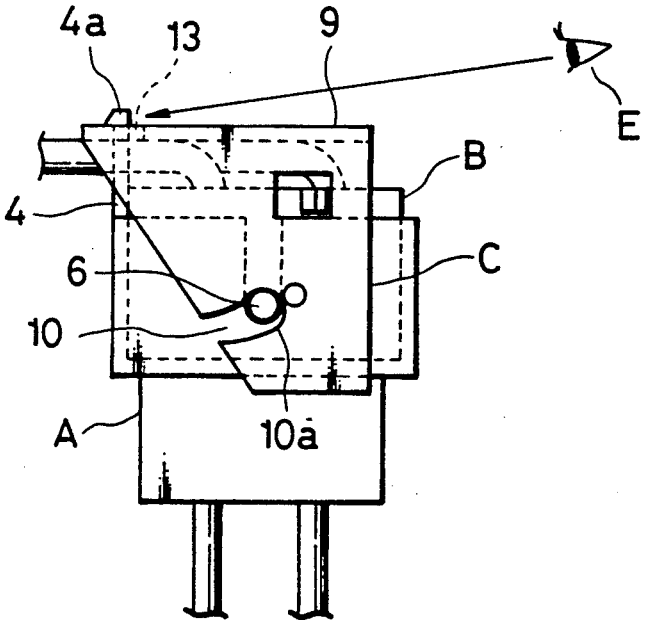

As shown in FIG. 2B, when the lever member C is generally upright, the fitting of the female and male housings A and B is completed and the female and male metallic terminal members thereof are electrically connected. Simultaneously, the engagement projections 7 are engaged with the engagement holes 11 to lock the lever portions 8. That is, when the lever portions 8 are in the locked position, the female and male housings A and B are completely fitted to each other.

When the female and male housings A and B are fitted and when the lever member C is in the locked position, there is a play between each driven pin 6 and the circular inner end 10*a* of the mating drive slit 10, and there is also a play between each engagement projection 7 and the mating engagement hole 11. If the lever member C is further rotated in the direction of arrow P. The sensed lock portions 4 are engaged with the lock holes 13 of the operation plate 9 so that their ends 4*a* project out of the holes 13, thereby locking the lever member. The projecting state of the ends 4*a* can easily be confirmed with the eye E of a person who assembles or inspects the connector.

Figure 3:
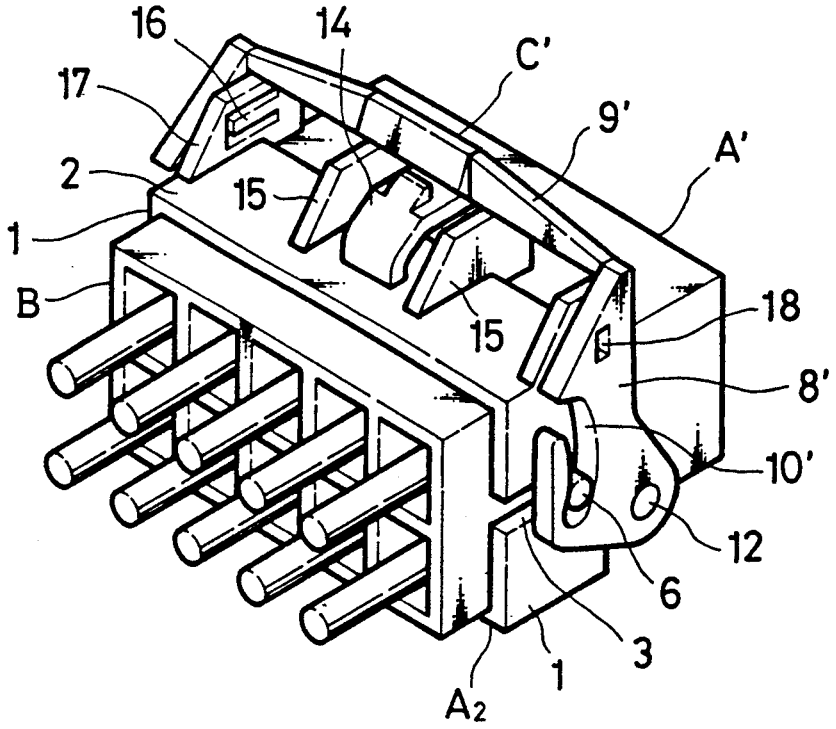
FIG. 3 is a perspective view of a connector with a lever in accordance with a second embodiment of the present invention in a state where male and female housings are fitted and locked with a lever member.

FIG. 3 shows the second embodiment of the present invention in which when female and male housings A′ and B′ are completely fitted to each other, a lever member C′ is locked on the hood $A_2$ side of the female housing A′, and a sensed lock means the state of which is confirmed with eye is provided on the hood $A_2$ and arms 8′.

That is, the hood $A_2$ of the female housing A′ has in its left and right end walls 1 pin guide slits 3 for guiding driven pins 6 of the male housing B′, and a pairs of left and right lever portions 8′ having drive slits 10′ are rotatably attached to the two end walls 1 by pin shafts 12. The lever portions 8′ are connected by an operation plate 9′ to form a lever member C′.

An elastic engagement arm 14 is formed on a central portion of one of the longitudinal side walls 2 of the hood $A_2$, and protective walls 15 are formed on the same on the opposite sides of the elastic engagement arm 14. Also, flanges 17 having sensed lock portions 16 are formed on opposite end portions of this side wall. Lock holes 18 capable of engaging with the sensed lock portions 16 are formed in the lever portions 8′.

Figure 4A:
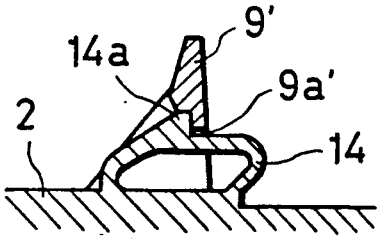
FIG. 4A is a partial sectional view of a state where the lever member C' shown in FIG. 3 is in a locked position.
Figure 4B:
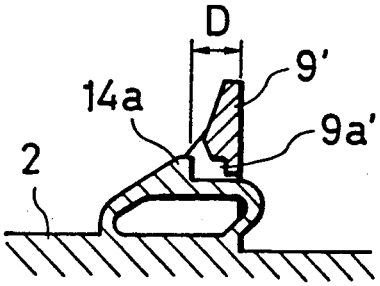
FIG. 4B is a partial sectional view of a state where the lever member C' is in a sensed position (eye-confirmation position)

As shown in FIGS. 4A and 4B, the elastic engagement arm 14 has an even-span-beam structure or an annular structure, can be elastically displaced freely in a direction generally perpendicular to the surface of the side wall 2, and has an engagement projection 14*a* for engagement with an inner edge of an engagement step portion 9*a*′ of the operation plate 9′. FIG. 4A shows a state in which the engagement step portion 9*a*′ of the operation plate 9′ is engaged with the engagement projection 14*a* to lock the lever member C′, when the female and male housings A′ and B′ are fitted to each other by the operation of rotating the lever member C′, as in the case of the first embodiment. FIG. 4B shows that the lock means has a play (overstroke) such that the operation plate 9′ can be further moved to the rear by a distance D from the locked position after the housings have been fitted.

Figure 5A:
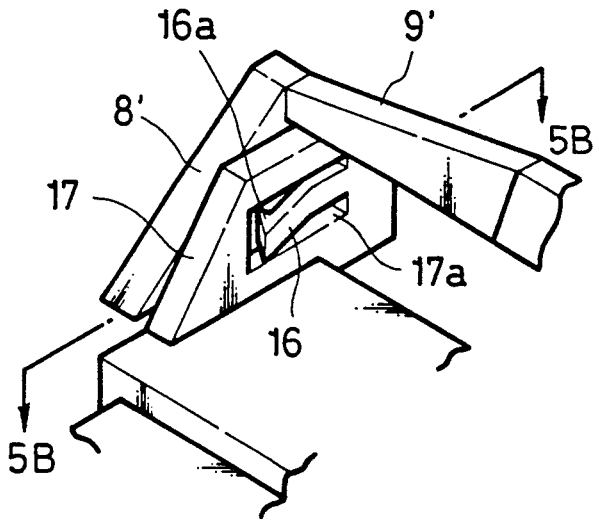
FIG. 5A is an enlarged perspective view of sensed lock portions 16 and levers 8' shown in FIG. 3.
Figure 5B:
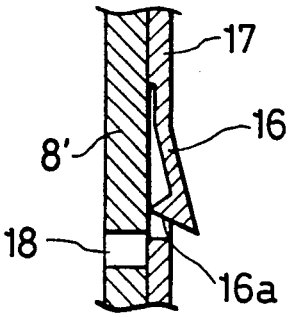
FIG. 5B is a cross-sectional view taken along the line 5B—5B of FIG. 5A.

As shown in FIGS. 5A and 5B, each sensed lock portion 16 is formed at the center of the flange 17 integrally with the same so that a generally U-shaped slip 17*a* is formed therebetween, and has a lock claw 16*a* formed at its free end so as to project out of the flange 17. FIGS. 5A and 5B show a state in which the lever member C′ is in the locked position shown in FIG. 4A while the lock claws 16*a* are being pressed by the lever portions 8′ so as to be bent inwardly inside the flange 17.

Figure 6A:
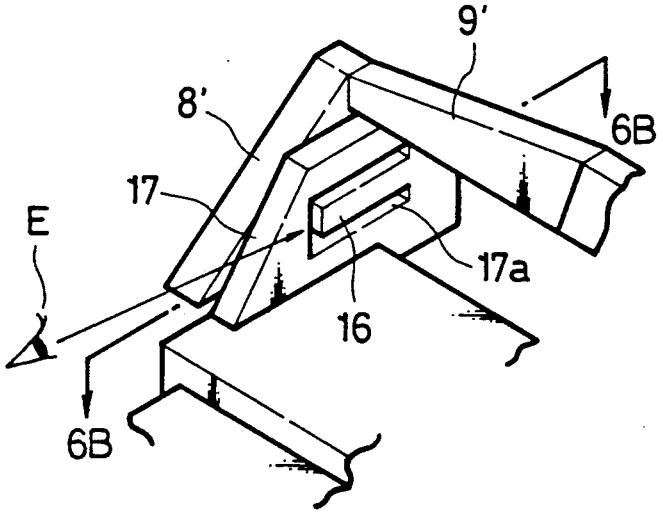
FIG. 6A is an enlarged perspective view corresponding to FIG. 5A, showing a state where the levers 8' in a sensed position.
Figure 6B:
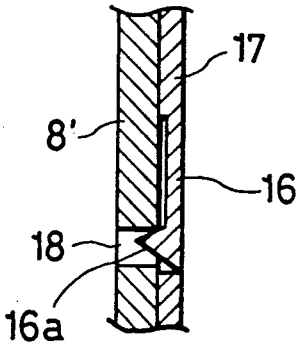
FIG. 6B is a cross-sectional view taken along the line 6B—6B of FIG. 6A.
Figure 7A:
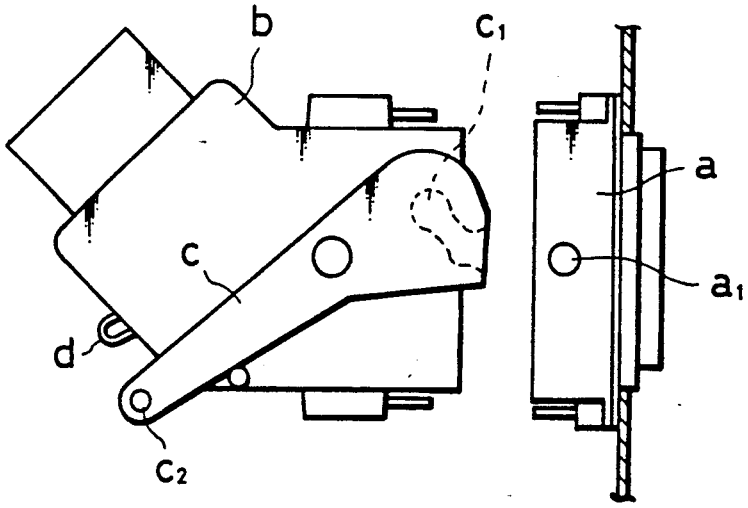
FIG. 7A PRIOR ART
FIG. 7A is a side view of a conventional connector with a lever in a state before fitting and locking.
Figure 7B:
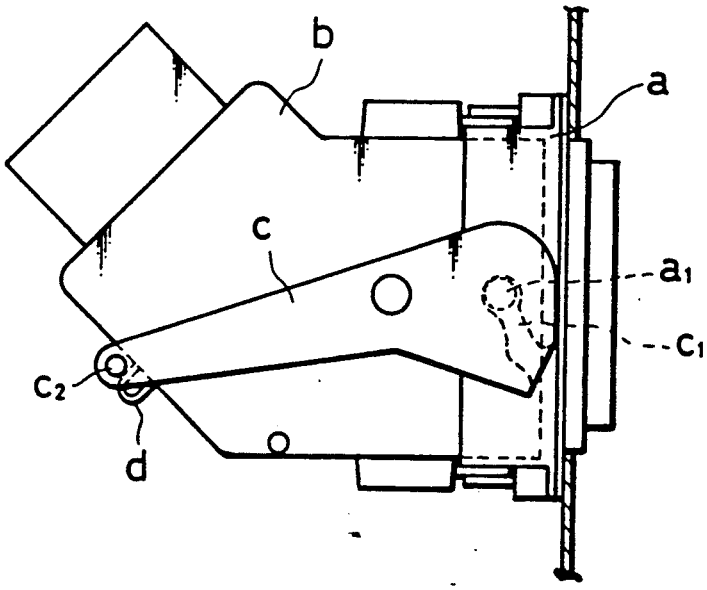
FIG. 7B PRIOR ART
FIG. 7B is a cross-sectional view taken along the line 7B—7B of FIG. 7A.

FIGS. 6A and 6B show a state in which the lever member C′ is moved to the position shown in FIG. 4B, the sensed lock portions 16 are in an elastically restored state, and the lock claws 16*a* are engaged with the lock holes 18 of the levers 8′, i.e., in the eye-observation position.

As described above with respect to the first and second embodiments, the lock means (engagement projections 7, engagement holes 11, elastic engagement arms 14, and engagement step portions 9*a*′) and the sensed lock means (sensed lock portions 4, lock holes 13, sensed lock portions 16, and lock holes 18) of the lever members C and C′ are separated from each other to enable application to a variety of connectors, thereby improving the facility with which a connector is designed and manufactured.

Specifically, the sensed lock means can be provided in a position on the connector such as to be seen most easily, so that the fitted state of the male and female housings can easily be confirmed. It is thereby possible to securely fit and lock the pair of male and female housings. Further, the two housings are doubly locked by the lever lock means and sensed lock means, and the desired locked state of the housing can be ensured by lever locking even if the eye-confirmation of the sensed lock means is omitted.

What is claimed is:

1. A connector with a lever comprising:

a pair of opposed housings capable of being fitted to and detached from each other;

guide slits formed in one of said pair of housings so as to extend generally in the direction of fitting to the other of said housings;

driven pins provided on the other of said housings on the outside thereof;

lever means rotatably attached to said one of said housings, said lever means having drive slits capable of engaging with said driven pins, said lever means being rotatingly operated to fit or detach said housings;

first lock means having a pair of members, one of which is provided on one of said pair of housings and the other provided on said lever means, said members being connected when said housings are normally fitted to each other; and second lock means having a pair of members, one of which is provided on one of said pair of housings and the other provided on said lever means, said members being operative as confirmation of normal fitting when said housings are normally fitted to each other.

2. A connector with a lever according to claim 1, wherein said first lock means has a space for free and easy movement between said members when they are connected, and said second lock means becomes effective when said lever means is further rotated in the connector fitting direction.

3. A connector with a lever comprising:

a pair of opposed male and female housings capable of being fitted to and detached from each other;

guide slits formed in said female housing so as to extend generally in the direction of fitting to said male housing;

driven pins provided on said male housing and capable of being inserted into and guided along said guide slits;

lever means rotatably attached to said female housing, said lever means having drive slits capable of engaging with said driven pins of said male housing, said lever means being rotatingly operated to fit or detach said housings;

first lock means having a pair of members, one of which is provided on said male housing and the other provided on said lever means, said members being connected when said housings are normally fitted to each other; and second lock means having members provided on said female housing and said lever means to be operated as confirmation of normal fitting when said housings are normally fitted to each other.

4. A connector with a lever according to claim 3, wherein said first lock means includes an engagement projection provided on said male housing and an engagement hole formed in said lever means, and said second lock means includes a lock portion provided on said female housing so as to project in the fitting direction, and a lock hole formed in said lever means.

5. A connector with a lever according to claim 4, wherein each of said drive slits of said lever means has a circular end portion in which the corresponding one of said driven pins is loosely fitted when said housings are fitted to each other, and said engagement hole is formed so as to be larger than said engagement projection so that said engagement hole and said engagement projection engage with each other with a play when said housings are fitted to each other.

6. A connector with a lever according to claim 3, wherein said first lock means includes an elastic engagement arm protrusively formed on said male housing, and an engagement step provided on said lever means.

7. A connector with a lever according to claim 6, wherein said elastic engagement arm is an even-span-beam-like member having a projection capable of engaging with said engagement step, the distance between said projection and the opposite beam end is greater than the corresponding size of said engagement step so that said engagement step and said engagement arm engage with each other with a play when said housings are fitted to each other.

8. A connector with a lever according to claim 6, wherein each of said housings has left and right end walls and longitudinal front and rear side walls, and said lever means has a pair of lever portions disposed on the left and right sides to face each other and an operation plate connecting said lever portions, said first lock means being provided on said end walls of said male housing and said lever portions, said second lock means being provided on one of said side walls of said female housing and said operation plate.

* * * * *